US005223898A

United States Patent [19]

Fujii et al.

[11] Patent Number: 5,223,898

[45] Date of Patent: Jun. 29, 1993

[54] DEVELOPING APPARATUS WITH THE FOLLOWING ROLLER CLOSER TO THE DRUM THAN THE FIRST ROLLER

[75] Inventors: Jiro Fujii, Kadoma; Yasuaki Tamura, Higashiosaka; Kazuhisa Kondo, Tokyo; Hidekazu Shono, Kawanishi, all of Japan

[73] Assignee: Mita Industrial Co., Ltd., Osaka, Japan

[21] Appl. No.: 540,640

[22] Filed: Jun. 19, 1990

[30] Foreign Application Priority Data

Jun. 29, 1989 [JP] Japan ..... 1-167498
Jun. 29, 1989 [JP] Japan ..... 1-167499
Jun. 29, 1989 [JP] Japan ..... 1-167500

[51] Int. Cl.[5] ..... G03G 15/06

[52] U.S. Cl. ..... 355/259; 118/656; 355/245; 355/253

[58] Field of Search ..... 355/208, 245, 246, 251, 355/252, 253, 259, 260; 118/656, 657, 658, 653

[56] References Cited

U.S. PATENT DOCUMENTS 3,640,248 2/1972 Nielander ..... 118/637
4,098,228 7/1978 Ruckdeschal et al. ..... 118/658
4,261,290 4/1981 Yamashita et al. ..... 118/658
4,394,429 7/1983 Hays ..... 118/653 X
4,580,888 4/1986 Thompson et al. ..... 355/3 DD

FOREIGN PATENT DOCUMENTS 0109374 8/1981 Japan ..... 118/658
0174863 10/1984 Japan ..... 355/253
2037620 7/1980 United Kingdom ..... 118/657
2141048A 12/1984 United Kingdom .

*Primary Examiner*—A. T. Grimley
*Assistant Examiner*—Christopher Horgan
*Attorney, Agent, or Firm*—Beveridge, DeGrandi, Weilacher & Young

[57] ABSTRACT

A developing apparatus is used for developing a photoconductive drum in a copying machine. The developing apparatus comprises a following developing roller for developing said photoconductive drum, an opposing developing roller for developing a photoconductive drum before the following developing roller, a supply mechanism for supplying developer to the developing rollers, a developer-quantity-regulator plate disposed between the following developing roller and the supply mechanism, and a limiting plate for limiting the length of the magnetic brush formed on the following developing roller. The distance between the photoconductive drum and the opposing developing roller is larger than the distance between the photoconductive drum and the following developing roller. The regulator plate is disposed apart from the developing rollers at a distance longer than the length of their magnetic brushes. The distance between the following developing roller and the limiting plate is within the length of the magnetic brush formed when the following developing roller starts rotating and the length of the magnetic brush formed when the following developing roller rotates at a constant speed.

17 Claims, 3 Drawing Sheets

DEVELOPING APPARATUS WITH THE FOLLOWING ROLLER CLOSER TO THE DRUM THAN THE FIRST ROLLER

BACKGROUND OF THE INVENTION

The present invention relates to a developing apparatus for use in an image forming apparatus. More specifically, it relates to a developing apparatus for developing a photoconductive drum of an image forming apparatus.

(1) Japanese Patent Publication No. 49586/1984 discloses a developing apparatus of an electrophotographic copying machine which comprises a housing adjacent to a photoconductive drum, an opposing developing roller and a following developing roller rotatably installed in the housing, and a supply mechanism for supplying developer to the developing rollers. In this developing apparatus, the distance between the photoconductive drum and the opposing developing roller is smaller than that between the photoconductive drum and the following developing roller.

Since the distance of the opposing developing roller to the photoconductive drum is smaller than that of the following developing roller, the conventional developing apparatus causes the phenomenon shown in FIG. 1. In FIG. 1, number 50 designates a photoconductive drum, number 51 designates an opposing developing roller, and number 52 designates a following developing roller. Arrows show the rotation directions of the rollers. Developer 53 is indicated by small dots.

As used in this specification and shown in FIGS. 1 and 3, the term "opposing developing roller" refers to a roller whose axis is turning in the same direction as the axis of the photoconductive drum and is positioned such that the surface of the opposing developing roller is turning opposite to the direction which the photoconductive drum surface is turning. The opposing developing roller is shown at reference number 51 in FIG. 1 and reference number 22 in FIG. 3. Likewise, in this specification, the term "following developing roller" refers to a roller whose axis is turning in the opposite direction as the axis of the photoconductive drum and is positioned such that the surface of the following developing roller is turning in a direction which follows the direction which the photoconductive drum surface is turning. The following developing roller is shown at reference number 52 in FIG. 1 and reference number 23 in FIG. 3.

In FIG. 1, the developer 53 drawn up first by the following developing roller 52 can pass through the gap between the rollers 51 and 52, and then about half that amount is transferred to the opposing developing roller 51. The two divided portions of the developer 53 are transferred toward the photoconductive drum 50 by the rotation of the rollers 51 and 52. Since the photoconductive drum 50 rotates in the direction opposite to the direction of developer 53 transferred by the opposing developing roller 51, there is a tendency to transfer the developer 53 from the opposing developer 51 toward the following developing roller 52 by the rotation of the photoconductive drum 50. Consequently, a portion of the developer 53 accumulates on the opposing developing roller 51, hanging like an icicle (see part indicated P in FIG. 1), and such portion of the developer 53 is reverted to the following roller 52. That causes an excess amount of the developer 53 to be supplied to the following developer 52, whereby the load on the following developing roller 52 is increased and copy quality is lowered. According to experiments performed by the inventors of the present invention, the phenomenon became more pronounced as the distance between the opposing developing roller 51 and the photoconductive drum 50 was made narrower than that between the following developing roller 52 and the photoconductive drum 50.

(2) United Kingdom Patent Application GB 2,141,048A discloses a developing apparatus of an electrophotographic copying machine which comprises a housing adjacent to a photoconductive drum, developing rollers rotatably installed in the housing, and a regulator plate disposed in the part of developer to be supplied to the developing rollers. In this developing apparatus, the gap between the regulator plate and the lower developing roller becomes filled with developer, because the gap the developer passes is narrow. The developer which has passed the gap is transferred forward the photoconductive drum by the developing rollers to develop the electrostatic latent image on the photoconductive drum.

In this conventional developing apparatus, developer is deposited between the regulator plate and the developing roller, wherein particles of the developer become magnetically adhered to each other due to magnetization by the developing roller. As a result, the developer becomes a hardened mass in the gap between the regulator plate and the developing roller, making rotation of the developing roller difficult. Consequently, increased torque on the developing roller is required, due to the heavier load on the developing roller.

Moreover, the gap between the regulator plate and the developing roller is not narrow enough whereby it may act as a measure for measuring the amount of the developer. The amount of developer that is drawn up by the developing roller is largely self-determined. That is, the entire amount of the developer drawn up by the developing roller by magnetic force can pass the gap between the developing roller and the regulator plate. As the developer is transported by the developing roller, it forms a magnetic brush on the surface of the developing roller corresponding to the magnetic force of the developing roller. Thus, the regulator plate of the developing apparatus cannot act to limit the length of the magnetic brush, whereby the load on and abrasion of the developing roller in the common type of developing apparatus are reduced, and wherein the regulator plate always controls the length of the magnetic brush by trimming the top portion of the magnetic brush.

In this conventional developing apparatus, as described above, the length of the magnetic brush is self-determined by means of the developing roller, wherein the length of the magnetic brush is stable and constant as long as the developing roller rotates at a constant speed. However, at the start of the developing process, or when the developing roller begins to rotate, the developing roller momentarily tends to carry a large amount of developer due to its slow initial speed of rotation. Therefore, in the conventional apparatus, a large excess amount of developer is supplied to the photoconductive drum, causing an increase of scattered toner and a sudden change in load.

SUMMARY OF THE INVENTION

It is an object of the present invention to provide a developing apparatus which requires relatively low developing-roller torque.

It is another object of the present invention to provide a developing apparatus which decreases the supplying of excess developer to a developing roller caused by the rotation of the photoconductive drum, and which thereby results in less disruption of an image and reduction in load on the developing roller.

It is yet another object of the present invention to provide a developing apparatus which impedes a large amount of excess developer form being transferred by the developing rollers at the start of the developing process wherein a large amount of excess developer causes increased toner scattering and a sudden change in load.

(1) According to an aspect of the present invention, a developing apparatus is an apparatus for developing a photoconductive drum. The developing apparatus comprises a following developing roller for developing the photoconductive drum, an opposing developing roller for developing the photoconductive drum before the following developing roller, and a supply mechanism for supplying developer to the developing rollers. The distance between the photoconductive drum and the opposing developing roller is longer than that between the photoconductive drum and the following developing roller.

In this developing apparatus, the supply mechanism supplies the developer to the developing rollers. The opposing developing roller first develops a latent image on the photoconductive drum, and then the following developing roller develops the image.

The opposing developing roller transfers the developer in the direction opposite to the direction of the rotation of the photoconductive drum. Accordingly, the photoconductive drum tends to retrograde developer onto the opposing developing roller. However, in this developing apparatus, the distance between the photoconductive drum and the opposing developing roller is longer than that between the photoconductive drum and the following developing roller, so that the tendency to retrograde is diminished, and the developer on the opposing developing roller can be properly transferred in the direction of the rotation of the opposing developing roller. This solves the problem wherein a large amount of developer on the opposing developing roller is reverted to the following developing roller by the rotation of the photoconductive drum.

(2) According to another aspect of the present invention, a developing apparatus is an apparatus for developing a photoconductive drum. This developing apparatus comprises developing rollers adjacent to the photoconductive drum, a supply mechanism for supplying developer to the developing rollers, and a regulator plate for controlling the quantity of developer flow toward the developing rollers, disposed between the developing rollers and the supply mechanism. The regulator plate is located apart from the developer layer formed on the developing rollers.

In this developing apparatus, when the supply mechanism supplies the developer to the developing rollers, the regulator plate controls the quantity of the developer flow (to the developing rollers). The developing rollers rotate to develop the photoconductive drum with the received developer.

The regulator plate is located apart from the developer layer formed on the developing rollers, that is, the magnetic force of the developing roller does not substantially reach the regulator plate. Accordingly, since there is a gap between the regulator plate and the developer layer formed on the developing rollers, the space between the developing rollers and the regulator plate is not filled with the developer carried by the developing rollers. Therefore, the regulator plate is not an obstacle to the rotation of the developing rollers, whereby the present invention lowers the required driving force of the developing roller.

(3) According to yet another aspect of the present invention, a developing apparatus is an apparatus for developing a photoconductive drum. This developing apparatus comprises developing rollers adjacent to a photoconductive drum, a supply mechanism for supplying developer to the developing rollers, and a limiting plate for limiting the length of the magnetic brush formed on one of the developing rollers. The distance between the developing roller and the limiting plate is defined to be shorter than the length of the magnetic brush formed when the developing roller starts to rotate and greater than the length of the magnetic brush formed when the developing roller rotates at a constant speed.

In this developing apparatus, the supply mechanism supplies the developer to the developing rollers. The supplied developer forms the magnetic brush on the developing rollers.

When the developing process starts, a large amount of developer is momentarily carried on the developing roller to form a magnetic brush of excess length, due to an initially slow speed of rotation. This magnetic brush is limited in length by the limiting plate, whereby the magnetic brush is shortened. This results in less scattered toner and less sudden change in load at the start of the developing apparatus.

Subsequently, the developing roller rotates at a stable speed, so that the magnetic brush is stable in a short length on the developing roller. Under this condition, the limiting plate does not increase the load of the developing roller, because the limiting plate no longer limits the length of the magnetic brush.

These and other objects and advantages of the present invention will be more fully apparent from following the detailed description.

DESCRIPTION OF THE PREFERRED EMBODIMENT

Figure 2:
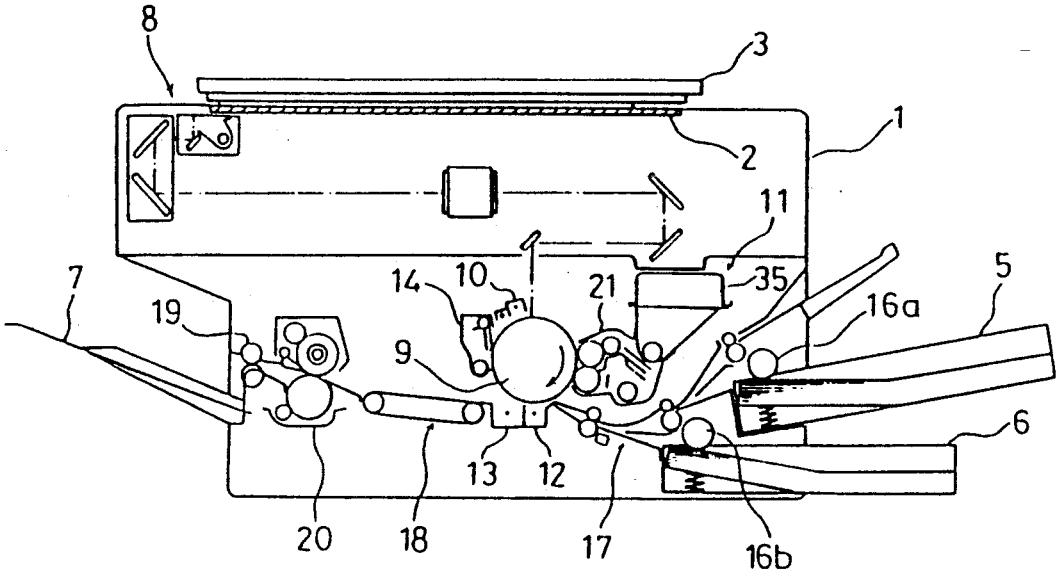
FIG. 2 is a sectional, schematic view showing a copying machine having a developing apparatus according to the present invention.

FIG. 2 is a sectional view showing a copying machine which includes an embodiment according to the present invention. In the figure, a copying machine body 1 has a contact glass 2 in the upper surface and an original holder 3 thereon which can be opened. On the right side of the machine body 1 in the figure, a pair of detachable paper cassette cases 5 and 6 are attached. On the left side of the machine body 1, a copy tray 7 is attached wherein copied paper is received.

In the machine body 1, an optical exposure system 8 for obtaining information from an original is located in the upper portion. The exposure system 8 consists of a light source, mirrors and so on. Disposed in the central part of the machine body 1 is a photoconductive drum 9 on which an electrostatic latent image is formed. Surrounding the photoconductive drum 9, there are a corona-generating main charger 10 for charging the photoconductive drum 9 with a predetermined level of electric charge, a developing apparatus 11 as an embodiment according to the present invention, a corona-generating transfer unit 12 for transferring a toner image to paper, a corona-generating detach unit 13 for detaching paper from the photoconductive drum 9, and a cleaning unit 14 for removing toner form the photoconductive drum 9, in that order.

On the attached ends of the paper cassettes 5 and 6, a pair of feeding rollers 16*a* and 16*b* are disposed. A paper feeding unit 17, for feeding material paper from the cassettes 5 and 6 to the image-forming part including the photoconductive drum 9, is located beyond the rollers 16*a* and 16*b* with respect to the paper flow direction (the right-to-left direction in FIG. 2). A transfer unit 18 is provided in a space beyond the image forming part with respect to the paper flow direction. A fixing unit 20 for fixing a transferred image onto the fed paper is disposed between the transfer unit 18 and ejecting rollers 19.

The developing apparatus 11 consists of an apparatus body 21 and a toner hopper 35 attached onto the body 21. The toner hopper 35 contains toner to be supplied to the body 21.

Figure 3:
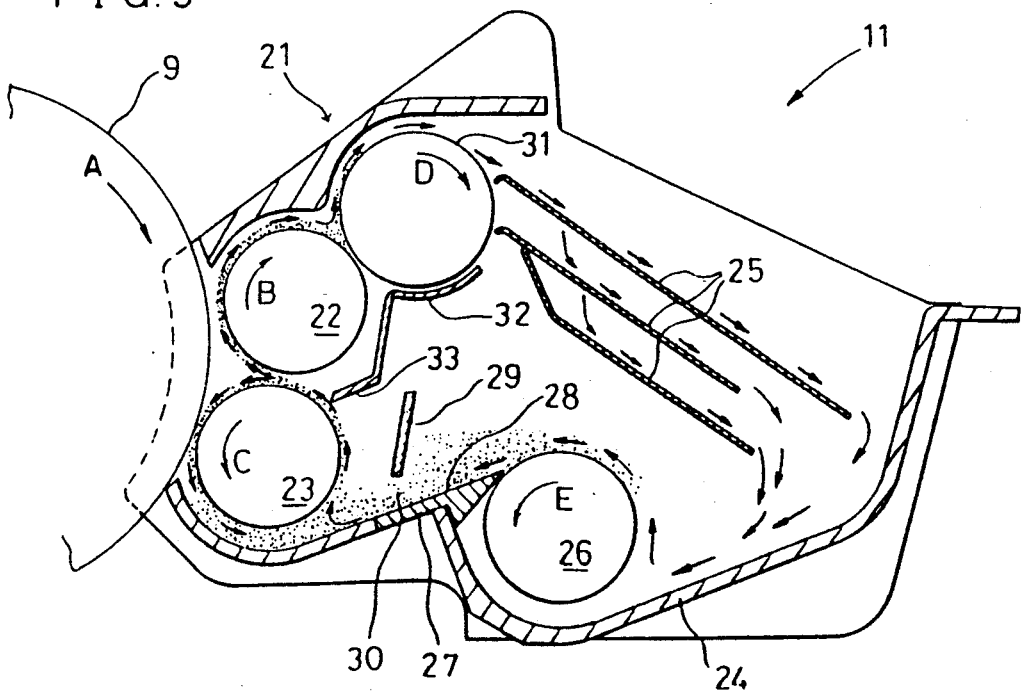
FIG. 3 is a sectional view showing the body of the developing apparatus.

Referring to FIG. 3: the apparatus body 21 is located adjacent to the photoconductive drum 9, which rotates in the direction of arrow A. The apparatus body 21 has an opposing developing roller 22 and a following developing roller 23 which are along side each other in parallel and face the photoconductive drum 9. The rollers 22 and 23 are disposed rotatably in directions opposite to each other in a housing 24, wherein the roller 22 is above the rollers 23. Both rollers 22 and 23 have a plurality of magnets (not shown) inside. The direction of the rotation of the opposing developing roller 22, shown by arrow B, is the same as that of the photoconductive drum 9, so that with respect to their facing portions, the surface of the roller 22 moves in the direction opposite to that of the photoconductive drum 9. The direction of the rotation of the following developing roller 23, shown by arrow C, is opposite to that of the photoconductive drum 9, so that in their facing portions, the surface of the roller 23 moves in the same direction as that of the photoconductive drum 9.

Both rollers 22 and 23 are apart from each other so that developer can be transferred between the rollers 22 and 23 by the magnetic force of the inner magnets. The distance between the photoconductive drum 9 and the opposing developing roller 22 is larger than that between the photoconductive drum 9 and the following developing roller 23. The ratio of the distance between the photoconductive drum 9 and the opposing developing roller 22 to the distance between the photoconductive drum 9 and the following developing roller 23 preferably ranges from 1.1 to 1.5, with the most preferable being 1.3. For example, the distance between the photoconductive drum 9 and the opposing developing roller 22 may be 1.3 mm, and the distance between the photoconductive drum 9 and the following developing roller 23 may be 1.0 mm.

Disposed in the housing below the toner hopper 35 are sloping plates 25 down along which toner dropping from the toner hopper 35 moves. The sloping plates 25 consists of three plates located apart from each other in parallel. The plates 25 have a number of perforations (not shown) to allow the toner to drop, whereby the toner is mixed with carrier to form developer as the toner moves down along the sloping plates 25.

Below the sloping plates 25, a mixing and transferring roller 26 is provided to mix the developer for inclusion of toner and for transferring the developer to the rollers 22 and 23. The mixing and transferring roller 26 is driven to rotate in the counterclockwise direction, shown by arrow E. The roller 26 also has a plurality of magnets (not shown) inside. Between the mixing and transferring roller 26 and the following developing roller 23, a developer transferring path 28 is provided which is formed wherein the housing 24 incorporates a guide member 27. Above the middle part of the developer transferring path 28, a regulator plate 29 for controlling the quantity of toner flow is located in a vertical extension. There is a gap 30 between the regulator plate 29 and the guide member 27 to control the quantity of toner flow. The gap 30 may be, for example, 7 mm in height. The regulator plate 29 is located apart from the following developer roller 23 at some distance. The distance between the regulator plate 29 and the following developing roller 23 may be, for example, 12 mm. The ratio of the distance between the regulator plate 29 and the following developing roller 23 to the distance between the regulator plate 29 and the guide member 27 preferably ranges from 1.5 to 2.0, and more preferably from 1.7 to 1.8. Although the magnet in the following developing roller 23 nearest to the regulator plate 29 is 530G in magnetic induction, but no substantial magnetic force from the magnet reaches the regulator plate 29. Consequently, the regulator plate 29 is located apart from the following developing roller 23 at a length longer than the thickness of the developer layer formed on the following developing roller 23, or longer than the length of the magnetic brush. That is, there exists a space between the regulator plate 29 and the developer layer—or the magnet brush—on the following developing roller 23.

A removing roller 31 is provided in a region beyond (with respect to the developer flow) the opposing developing roller 22, and the top ends of the sloping plates 25 are positioned a little lower than the removing roller 31. The removing roller 31 is driven to rotate in the direction shown by arrow D, which is the same as that of the opposing developing roller 22, and contains a plurality of magnets (not shown).

A separating plate 32 is provided adjacent to the removing roller 31 and the opposing developing roller 22 so that the separating plate 32 is opposite the photoconductive drum 9 (through the roller 22). The lower end of the separating plate 32 bends toward the following developing roller 23 and forms a limiting plate 33. The limiting plate 33 has its end located apart from the following developing roller 23 a little further than the thickness of the developer layer, or the length of the magnetic brush, formed on the following developing roller 23 when the roller 23 rotates at a constant speed. For example, the layer of the developer may be 1.8 mm in thickness, and the gap between the following developing roller 23 and the limiting plate 33 may be 2 mm in length. The ratio of the distance between the following developing roller 23 and the limiting plate 33 to the thickness of the constant layer of the developer formed on the following developing roller 23 preferably ranges from 1.0 to 1.6, more preferably from 1.0 to 1.3, and is best at 1.1. In other words, the distance between the limiting plate 33 and the constant layer formed on the following developing roller 23 is preferably in the range from 0.0 to 1.2 mm, more preferably from 0.0 to 0.6 mm, and is best at 0.2 mm. The limiting plate 33 is positioned above the stationary portion of the developer under the following developing roller 23 wherein a relatively large amount of developer accumulates (as indicated by a concentration of small dots in the region of the limiting plate 33 in FIG. 3). Thus, the end of the limiting plate 33 faces only onto the magnetic brush formed on the following developing roller 23.

The operation of the above embodiment will be described.

Wherein a copy is to be obtained, first the original holder 3 is opened, next an original is placed on the contact glass 2, and then the original holder 3 is closed.

When the start button (not shown) is pushed, the exposure system 8 moves to scan the original on the contact glass 2, whereby a latent image in correspondence with the original is recorded on the photoconductive drum 9.

Figure 4:
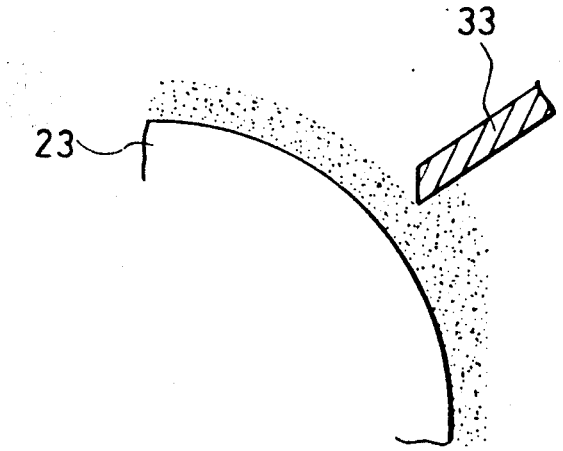
FIGS. 4 and 5 are sectional views showing part of a limiting plate.

Meanwhile, in the developing apparatus 11, each of the rollers 22, 23, 26 and 31 is driven to rotate as shown by the directions of the arrows. By this rotation, the developer is circulated in the body 21 of the developing apparatus 11 along the course shown by the small arrows. As circulation starts, the following developing roller 23 draws up developer from the stationary portion below the following developer roller 23, whereby a magnetic brush of the developer is formed on the following developing roller 23. However, the roller 23 initially must rotate slowly as it attains constant speed, whereupon a large excess amount of developer is brought onto the following developing roller 23. That is, a longer magnetic brush is temporarily formed. As shown in FIG. 4, the longer portion of the magnetic brush is brought to the limiting plate 33 by the rotation of the following developing roller 23, and the limiting plate 33 restrains the longer part of the magnetic brush. The top portion of the magnetic brush is removed, or trimmed, by the limiting plate 33, whereby its length is brought to the constant length, after the brush passes the limiting plate 33. Thus, even during the starting period in the developing apparatus 11, no large amount of excess developer can be supplied to the photoconductive drum 9, whereby undesirable developer scattering and sudden load change due to supplying a large amount of developer are suppressed.

Figure 5:
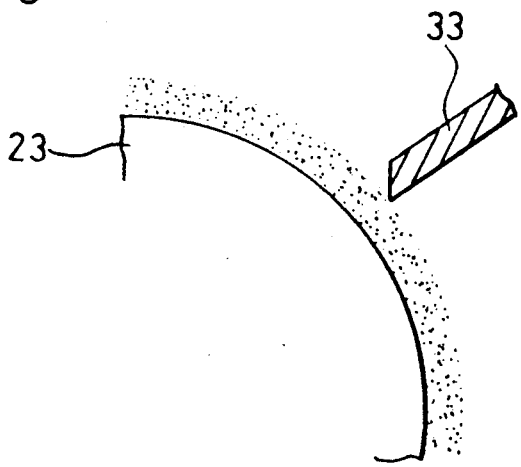

After the initial rise time in the developing process, the following developing roller 23 rotates at constant speed, so that a magnetic brush having a stable length is formed on the roller 23, as shown in FIG. 5. In this instance, the magnetic brush is about 1.8 mm in length, so that the magnetic brush remains apart from the end of the limiting plate 33 by a small gap. Therefore, the limiting plate 33 cannot take effect while the following developing roller 23 rotates at a constant speed, thereby the limiting late 33 does not create a load on the following developing roller 23.

The photoconductive drum 9 having an electrostatic latent image rotates in the direction of the arrow A in FIG. 3 to convey the latent image to the developing rollers 22 and 23 having the stable-length magnetic brushes thereon. Meanwhile, in the body 21 of the developing apparatus 11, the developer circulates along the course indicated by the small arrows. That is, the developer moves down along the sloping plates 25 to be mixed. Further along, the developer reaches the mixing and transferring roller 26 along the bottom surface of the housing 24. Then, the developer is mixed by the rotation of the roller 26 to become agitated. The agitated developer is transferred by the roller 26 along the developer transferring path 28 to the following developing roller 23. Since the regulator plate 29 is positioned above the middle part of the transferring path 28, the quantity of the developer flow is properly limited, or measured by the gap 30 between the guide plate 27 and the regulator plate 29. Therefore, a predetermined amount of the developer from the mixing and transferring roller 26 side is exactly transferred to the following developing roller 23.

The following developing roller 23 rotates in the direction shown by the arrow C. This rotation, and the magnets installed in the following developing roller 23, form a magnetic brush from the developer on the roller 23. Since the regulator plate 29 is located apart from the developer layer formed on the following developing roller 23, there exists some distance between the magnetic brush and the regulator plate 29. Therefore, the rotation of the following developing roller 23 is not disturbed by developer accumulating in the space between the following developing roller 23 and the regulator plate 29. As a result, excess load due to the developer movement cannot be put on the following developing roller 23, thereby only a small force of rotation of the following developing roller 23 is required.

The developer transferred by the following developing roller 23 is moved through the gap between the following developing roller 23 and the limiting plate 33 toward the photoconductive drum 9. When the following developing roller 23 rotates initially, the length of magnetic brush is not stable, consequently the magnetic brush may occasionally be longer than that wherein the roller 23 is rotating at a constant speed. In this interval, the limiting plate 33 functions, whereby the length of the magnetic brush is made constant. After the initial rise time, the following developing roller 23 rotates at constant speed, and the limiting plate 33 becomes inoperative. When the following developing roller 23 rotates at constant speed, the developer carried by the following developing roller 23 is entirely transferred under the limiting plate 33 toward the photoconductive drum 9, due to the fact that the magnetic brush is shorter than the distance between the roller 23 and the limiting plate 33.

Part of the developer carried by the following developing roller 23 is transferred to the opposing developing roller 22 to form a magnetic brush on the opposing developing roller 22. The magnetic brushes on the following developing roller 23 and the opposing developing roller 22 are conveyed to the photoconductive drum 9. Then, the developer reaches the developing position wherein it faces the photoconductive drum 9 and develops the electrostatic latent image onto the photoconductive drum 9. In this stage, the developer on the opposing developing roller 22 is moved in the direction opposite to the moving direction of the surface of the photoconductive drum 9, whereas the developer on the following developing roller 23 is moved in the direction following the moving direction of the photoconductive drum 9.

Figure 1:
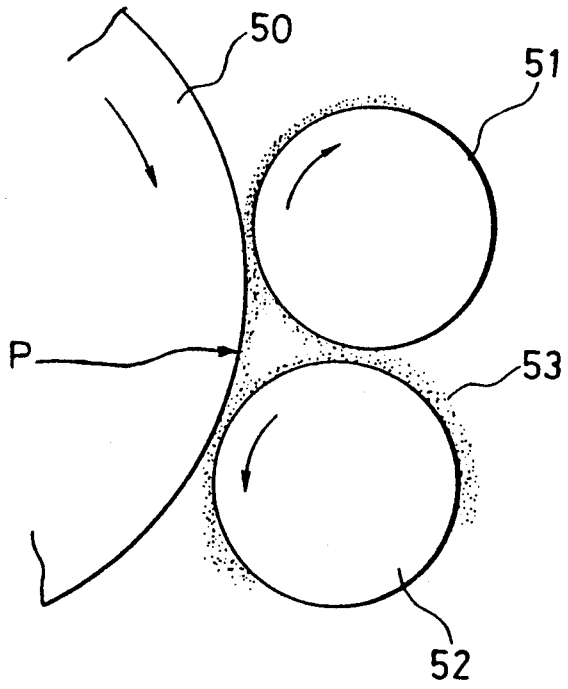
FIG. 1 PRIOR ART
FIG. 1 is a sectional side view showing a part of a conventional apparatus.

When the developer on the opposing developing roller 22 is transferred in the direction opposite to the moving direction of the surface of the photoconductive drum 9, the developer undergoes force from the photoconductive drum 9 whereby the developer is drawn back by the rotation of the photoconductive drum 9. However, since the distance between the photoconductive drum 9 and the opposing developing roller 22 is larger than that between the photoconductive drum 9 and the opposing developing roller 23 in this embodiment, passage developer through the gap between the photoconductive drum 9 and the opposing developing roller 22 is facilitated. Therefore, developer on the opposing developing roller 22 is not reverted to the following developing roller 23 by the rotation of the photoconductive drum 9, but is properly transferred toward the removing roller 31 by the rotation of the opposing developing roller 22. Thus, in the above embodiment, the conventional problem as shown in FIG. 1, namely the phenomenon indicated by the arrow P, does not occur.

The developer on the following developing roller 23 is moved in synchronization with the rotation of the photoconductive drum 9 to develop the electrostatic latent image. At this stage, developer on the opposing developing roller 22 is not reverted to the following developing roller 23 by the rotation of the photoconductive drum 9, so that no large amount of excess developer is supplied to the following developing roller 23, and the development is optimally carried out. Accordingly, wherein an excessive supply of developer reverted from the opposing developing roller 22 induces load increase on the following developing roller 23, which in turn may disarrange a toner image on the photoconductive drum 9, herein it does not occur.

The developer having passed through the developing position on the following developing roller 23 is transferred under the roller 23 toward the regulator plate 29. Meanwhile, the developer transferred from the opposing developing roller 22 to the removing roller 31 is further transferred to the sloping plates 25. If toner concentration in the developer is lower than a predetermined level, the toner hopper 35 supplies new toner onto the sloping plates 25.

As the photoconductive drum 9 developed by the developing apparatus 11 continues to rotate, the developed image on the photoconductive drum 9 is moved to the position of the transfer charger 12 and transferred by the transfer charger 12 to a sheet of material paper from either paper cassette 5 or 6. After transferring the image, the surface of the photoconductive drum 9 is cleaned by the cleaner 14. Meanwhile, the paper having the toner image is supplied to the fixing unit 20 by the transfer unit 18, and then the fixed paper is discharged to the copy tray 7.

Although the above embodiment has a pair of developing rollers 22 and 23, the regulator plate 29 and the limiting plate 33 can be employed also in a developing apparatus having one developing roller, or several developing rollers.

Experiments

The distance between the photoconductive drum 9 and the opposing developing rollers 22 was varied, while the distance between the photoconductive drum 9 and the following developing roller 23 was fixed. The experiment was performed with a developing apparatus which is the same as that in the above description.

The distance X between the photoconductive drum 9 and the following developing roller 23 was fixed at 1.0 mm, and the distance Y between the photoconductive drum 9 and the opposing developing roller 22 was varied as shown in Table 1. In the experiment, the main magnetic pole within the opposing developing roller 22 is set at an angle of $-12°$ with respect to the line between the centers of the photoconductive drum 9 and the opposing developing roller 22.

The results are shown in Table 1. Whether a result was normal or abnormal was decided contingent upon whether the developer formed any "icicle" portion, as indicated by the arrow P in FIG. 1.

TABLE 1

| Y | 0.9 mm | 1.0 mm | 1.1 mm | 1.2 mm | 1.3 mm |
|---|---|---|---|---|---|
| abnormal? | Yes | Yes | No | No | No |

As shown in Table 1, the developer performed abnormally in the range of $X \leqq Y$, but normally in the range of $X > Y$.

Next, the distance between the following developing roller 23 and the limiting plate 33 was varied. The distances are set at 1.5 mm, 2.0 mm, 2.5 mm and 3.0 mm, and the quality of the copied images were then checked. The experiment was performed with a magnetic brush of the following developing roller 23 whereof length was about 1.8 mm during constant rotation.

In the case of 1.5 mm, the developed image was disarranged by toner slippage. In the cases of 2.0 mm, 2.5 mm and 3.0 mm, sharp images were obtained on copies. However, in the cases of 2.5 mm and 3.0 mm, a large amount of toner was scattered from the developing apparatus 11.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for developing a latent image on a photoconductive drum of an image forming apparatus comprising:

a following developing roller for developing said latent image;

an opposing developing roller for developing said latent image located before said following developing roller, said opposing developing roller being located at a distance from said photoconductive drum which is larger than the distance between said following developing roller and said photoconductive drum; and supply means for supplying developer to said developing rollers.

2. An apparatus according to claim 1, wherein the ratio of the distance between said opposing developing roller and said photoconductive drum to the distance between said following developing roller and said photoconductive drum ranges from 1.1 to 1.5.

3. An apparatus according to claim 2, wherein said ratio is 1.3.

4. An apparatus according to claim 3, wherein the distance between said opposing developing roller and said photoconductive drum is 1.3 mm, and the distance between said following developing roller and said photoconductive drum is 1.0 mm.

5. An apparatus according to claim 1, wherein said opposing developing roller is positioned above said following developing roller.

6. An apparatus according to claim 5, further comprising a housing and a regulator plate for controlling the quantity of developer flow disposed between said following developing roller and said supply means and apart from said housing to provide a path through which the developer passes, and apart from a developer layer formed on said following developing roller, said regulator plate being at a distance from said following developing roller which is larger than said path.

7. An apparatus according to claim 6, further comprising a limiting plate for limiting the thickness of said developer layer on said following developing roller, said limiting plate being apart from said developing roller at a distance which is less than the thickness of said developer layer formed when said developer layer starts rotating and more than the thickness of said developer layer formed when said following developing roller rotates at a constant speed.

8. An apparatus according to claim 7, wherein said limiting plate is disposed above a stationary portion of developer which is under said following developing roller.

9. An apparatus according to claim 8 further comprising a separating plate having said limiting plate at its lower end and disposed to be opposite said photoconductive drum on the other side of said developing rollers.

10. An apparatus according to claim 9, wherein said supply means comprises a toner hopper for supplying toner, sloping plates for mixing toner having a plurality of perforations, disposed below said toner hopper, and a mixing and transferring roller disposed below said sloping plates.

11. An apparatus for processing an image comprising:

an optical system for obtaining image information from an original;

a photoconductive drum for forming an electrostatic latent image corresponding to the obtained image information;

an image processing part surrounding said photoconductive drum, which includes a developing apparatus having a following developing roller for developing the latent image, an opposing developing roller for developing the latent image located before said following developing roller, and supply means for supplying developer to said developing rollers; wherein the distance between said opposing developing roller and said photoconductive drum is larger than the distance between said following developing roller and said photoconductive drum;

paper supply means for supplying a sheet of paper to said image processing part; and a fixing unit for fixing the image onto said sheet of paper from said image processing part.

12. An apparatus for developing a latent image on a photoconductive drum of an image forming apparatus comprising:

developing rolling means adjacent to said photoconductive drum;

supply means for supplying developer to said developing rolling means;

a regulator plate for controlling the quantity of developer flow located apart from the developer layer formed on said developing rolling means and between said developing rolling means and said supply means; and a housing containing said developing rolling means, said supply means and said regulator plate, wherein said regulator plate is located apart from said housing to define a path through which the developer passes, and said regulator plate is apart from said developing rolling means at a distance larger than said path.

13. An apparatus according to claim 12, wherein the ratio of the distance between said regulator plate and said developing rolling means to the distance between said regulator plate and said housing ranges from 1.5 to 2.0.

14. An apparatus according to claim 13, wherein said ratio ranges from 1.7 to 1.8.

15. An apparatus according to claim 14, wherein the distance between said regulator plate and said housing is 7 mm, and the distance between said regulator plate and said developing rolling means is 12 mm.

16. An apparatus according to claim 15 further comprising a limiting plate for limiting the thickness of the developer layer formed on said developing rolling means, disposed apart from said developing rolling means in a distance shorter than the thickness of the developer layer formed when said developing rolling means starts rotating and longer than the thickness of the developer layer formed when said developing rolling means rotates at a constant speed.

17. An apparatus according to claim 16, wherein said developing rolling means comprises a following developing roller for developing said photoconductive drum, and an opposing developing roller for developing said photoconductive drum before said following developing roller; and said supply means comprises a toner hopper for supplying toner, a sloping plate having a plurality of perforations disposed below said toner hopper, for mixing toner, and a mixing and transferring roller disposed below said sloping plate.

* * * * *